US006345820B1

(12) United States Patent
Zucchi et al.

(10) Patent No.: US 6,345,820 B1
(45) Date of Patent: Feb. 12, 2002

(54) AIR HOCKEY SCORING HOOD WITH RADIUSED SIDE PROFILES

(75) Inventors: Jeffrey R. Zucchi, Evansville; James R. Allshouse, Newburgh, both of IN (US)

(73) Assignee: Indian Industries, Evansville, IN (US)

( * ) Notice: Subject to any disclaimer, the term of this patent is extended or adjusted under 35 U.S.C. 154(b) by 21 days.

(21) Appl. No.: 09/610,143

(22) Filed: Jul. 5, 2000

(51) Int. Cl.[7] ..... A63F 7/00

(52) U.S. Cl. ..... 273/148 R; 273/108.5; 473/471; 473/478

(58) Field of Search ..... 473/471, 476, 473/478; 273/108.1, 108.5, 108.57, 148 R; D21/318

(56) References Cited

U.S. PATENT DOCUMENTS 3,931,974 A * 1/1976 Goldfarb et al.
3,954,267 A * 5/1976 Freeman et al.
6,276,682 B1 * 8/2001 Yamashita et al.

* cited by examiner

*Primary Examiner*—William M. Pierce
(74) *Attorney, Agent, or Firm*—Woodard, Emhardt, Naughton, Moriarty & McNett

(57) ABSTRACT

A scoring hood for a gaming table, such as an air hockey table, is provided comprising a top, and two sides defining a goal opening which extends into the playing area of the table wherein the sides curve concavedly outwardly from the goal opening to the edge of the playing area.

22 Claims, 9 Drawing Sheets

AIR HOCKEY SCORING HOOD WITH RADIUSED SIDE PROFILES

This invention relates to gaming tables and particularly to gaming tables for playing air hockey. More specifically, this invention relates to a novel scoring hood for air hockey tables.

BACKGROUND OF THE INVENTION

Air hockey tables have become a popular entertainment game with apparatuses for playing the game ranging from large, robust, coin operated tables for arcades to compact, movable tables for home use. Some tables include decorative add-ons to simulate live hockey rinks and some include sophisticated mechanisms for automatic scoring and feeding of the puck onto the playing area.

Amid the large variety of designs for air hockey tables all retain the common features of a large open playing area of roughly rectangular shape bounded by retaining walls comprising raised edges to retain the puck on the playing area and to allow for the puck to ricochet off the walls. Another common feature of current air hockey tables is the basic construction of the goal opening. The most common configuration is a gap in the retaining wall of the playing area with the goal opening defined by the playing area surface on the bottom, the raised edges of the retaining wall on the sides and a low clearance hood across the top designed to allow the puck to slide off the playing area underneath the top and between the edges of the retaining wall.

A common difficulty with this standard scoring hood configuration is that missed shots on goal ricochet directly back into the playing area. This often results in retention of control of the puck by the player who took the shot. This result is not analogous to live hockey play where missed shots on goal often result in a change in control of the puck or at least an even scramble between opponents to gain control of the puck.

One alternative goal opening configuration is to place a hole in the playing area surface, spaced out from the retaining wall proportionately to the spacing of goals on a live hockey rink, and covering the hole with a scoring hood with a rectangular or pill shaped foot print. Such a scoring hood includes a top with supporting edges on three sides and defines a goal opening facing the center of the playing area, sized to allow a puck to slide under the top and into the hole in the playing area. Such an alternative design is meant to better simulate the play action of live hockey.

Though this scoring hood configuration closely approximates the appearance of a live hockey rink, the configuration creates a relatively dead space behind the goal, which unlike live hockey, is controllable and accessible by only one player.

The present invention provides a new configuration for a scoring hood that alleviates the problem of direct ricochet of missed shots on goal, but without producing dead spaces on the playing area. The scoring hood of the present invention results in a more lively and even play action.

DESCRIPTION OF THE PREFERRED EMBODIMENTS

Figure 1:
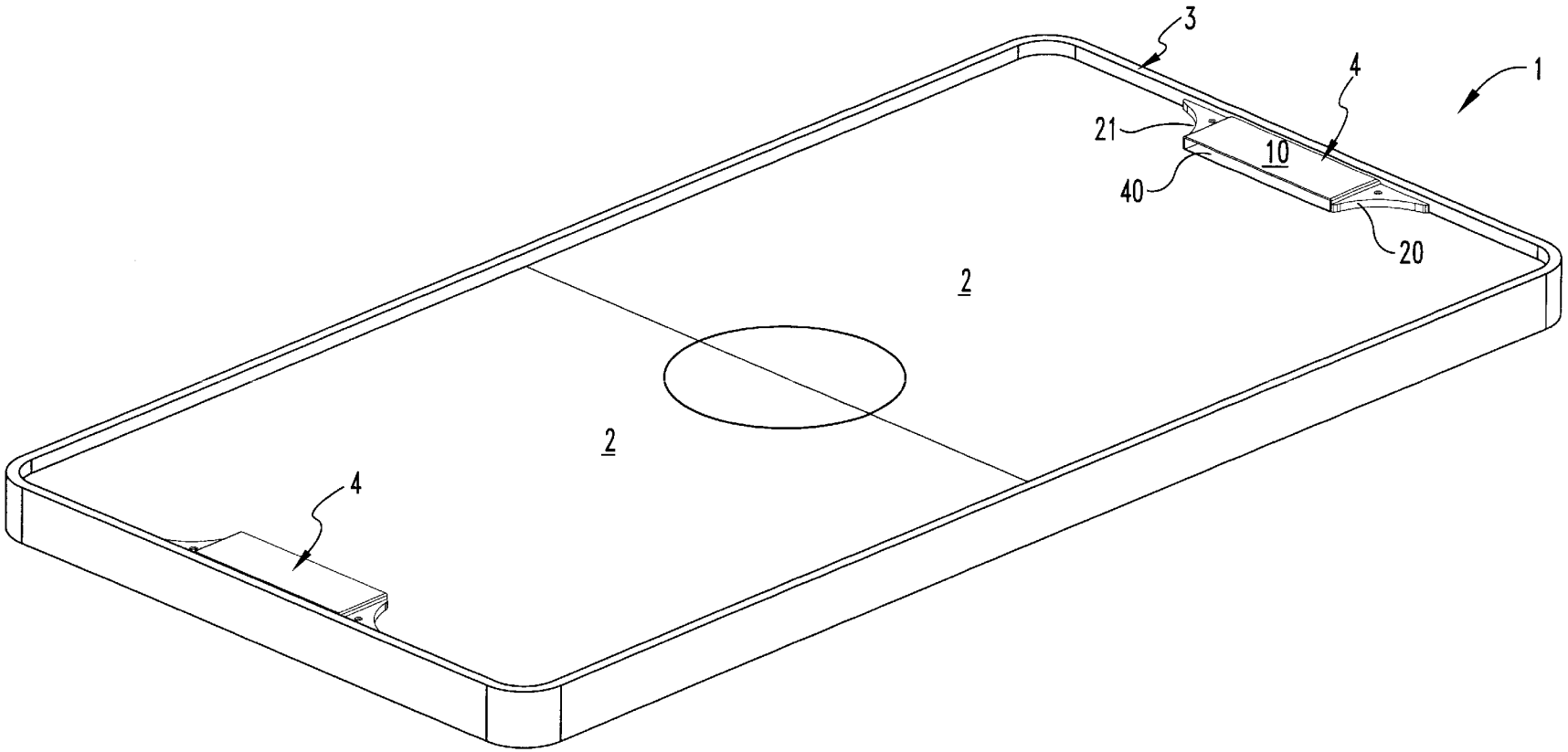
FIG. 1 is a diagrammatic view of an air hockey table including the novel scoring hood.
Figure 2D:
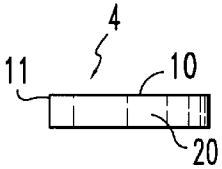
FIGS. 2–8 show perspective, top, front and side views of seven embodiments of the inventive scoring hood.
Figure 2A:
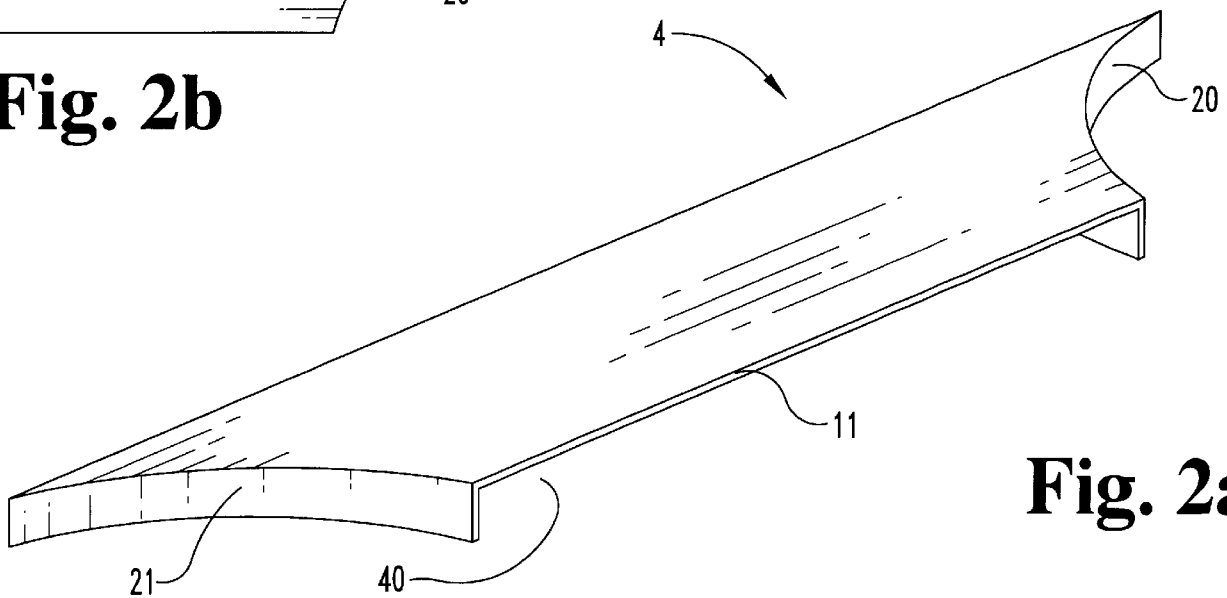
Figure 2C:
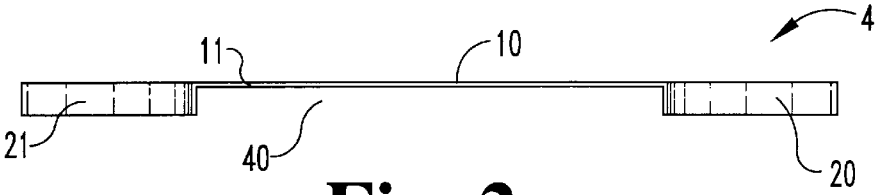
Figure 2B:
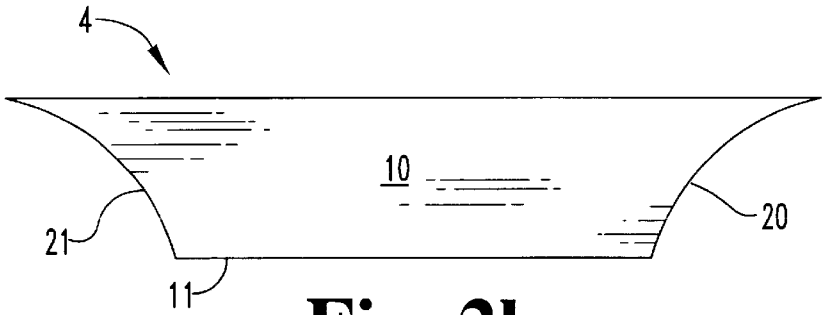
Figure 3D:
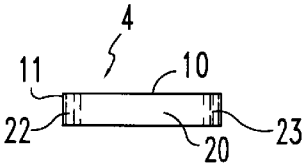
Figure 3C:
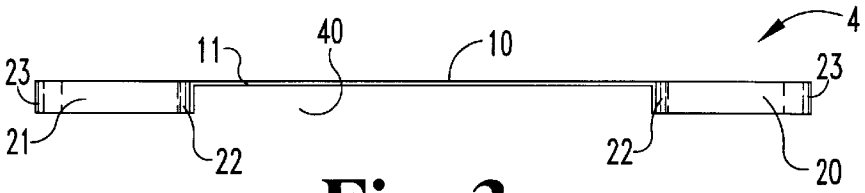
Figure 3B:
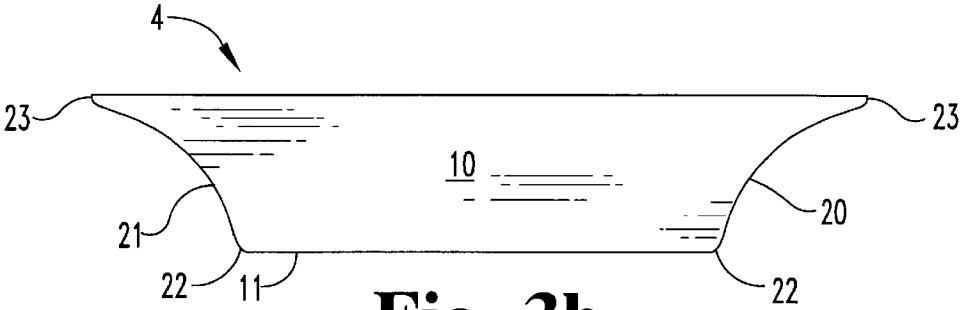
Figure 3A:
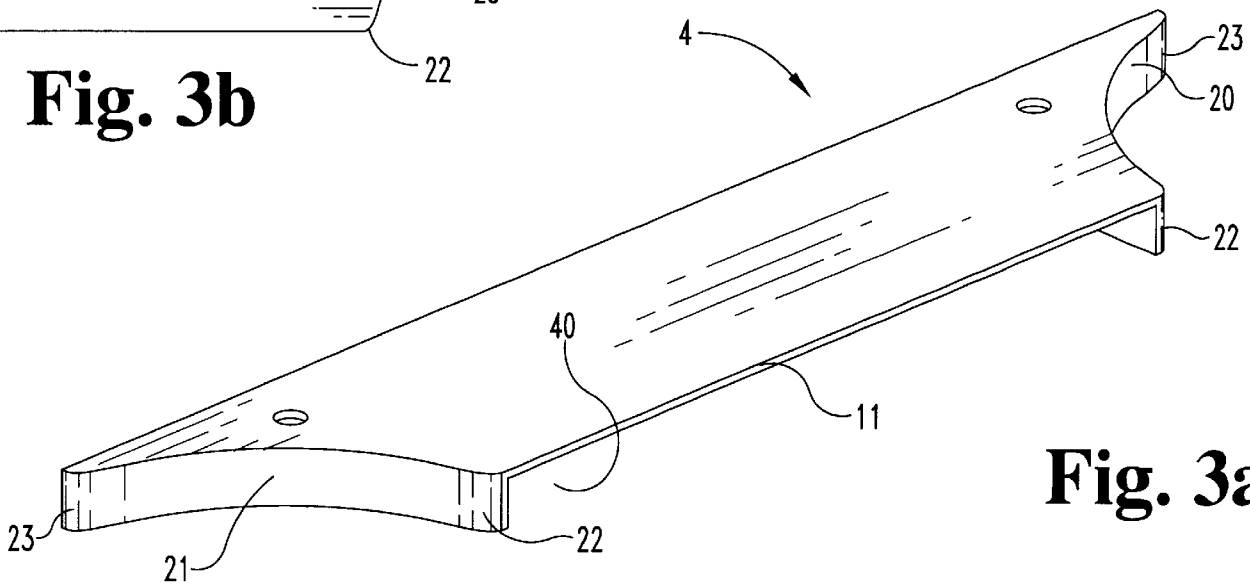
Figure 4D:
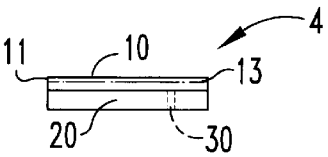
Figure 4C:
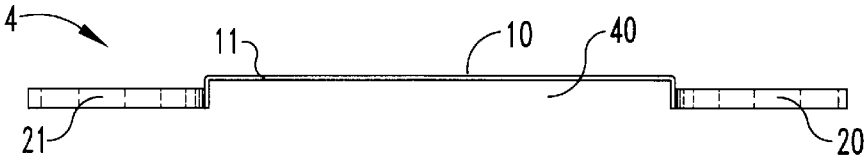
Figure 4B:
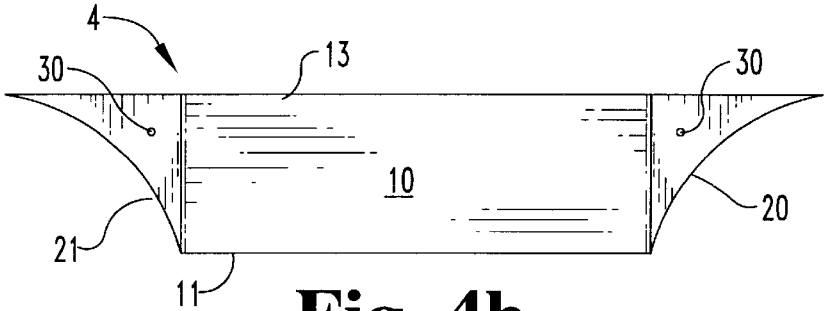
Figure 4A:
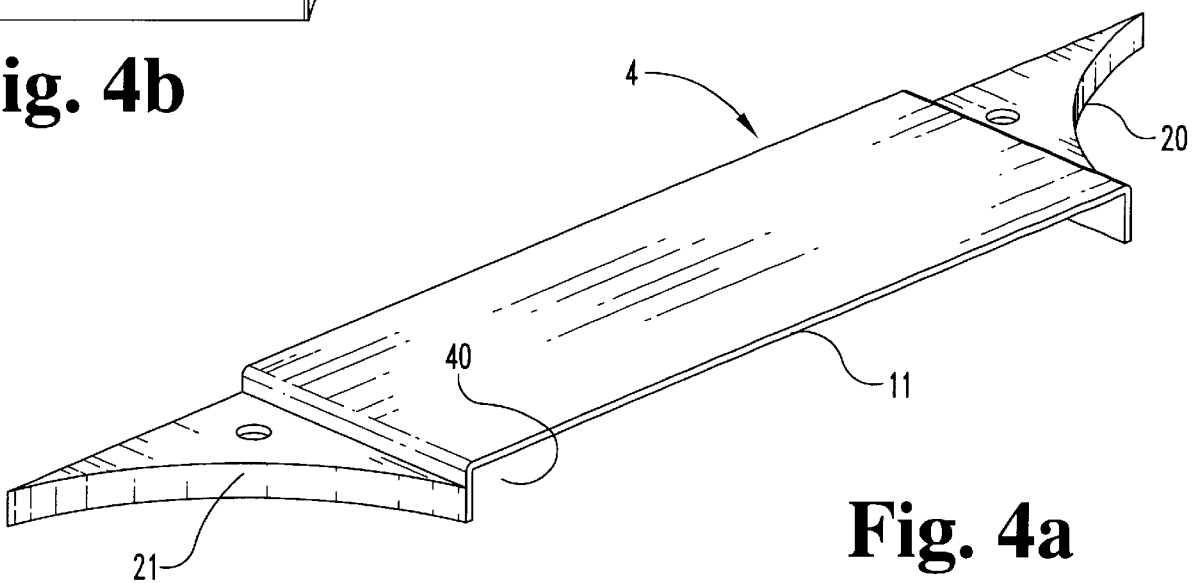
Figure 5D:
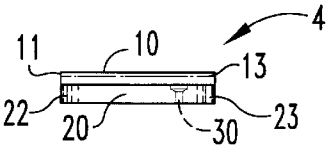
Figure 5C:
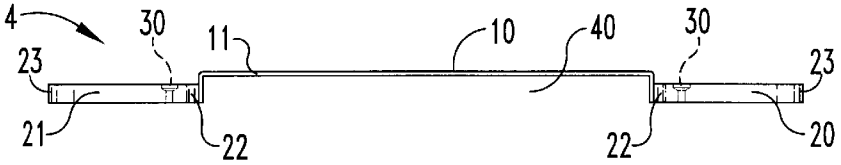
Figure 5B:
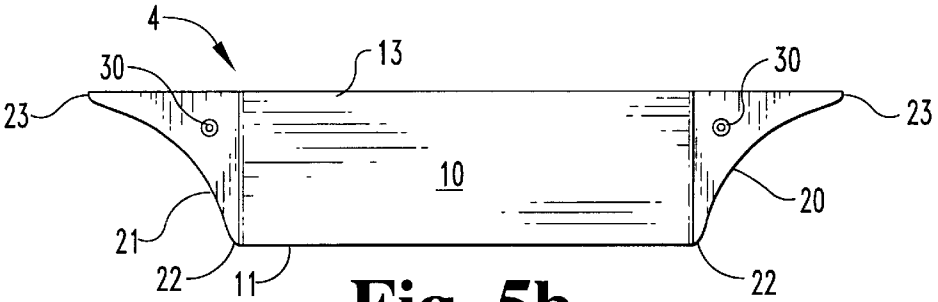
Figure 5A:
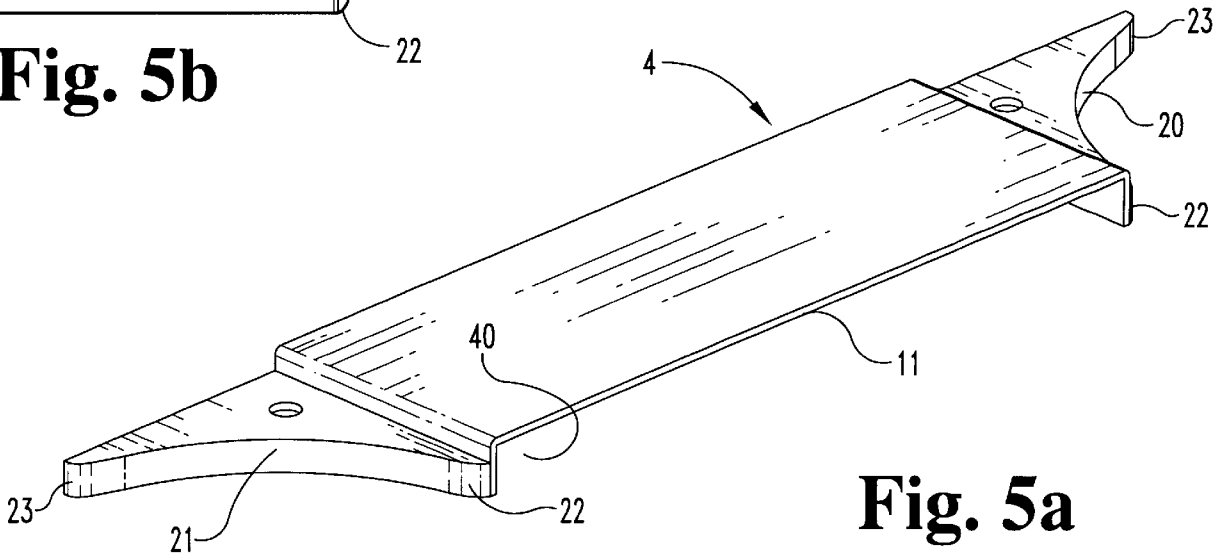
Figure 6D:
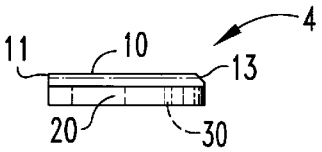
Figure 6C:
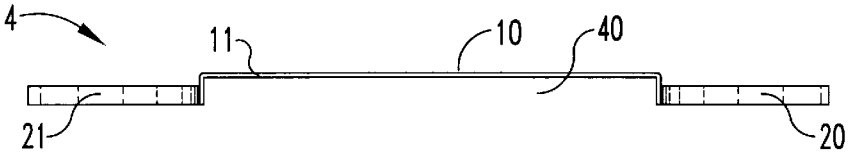
Figure 6B:
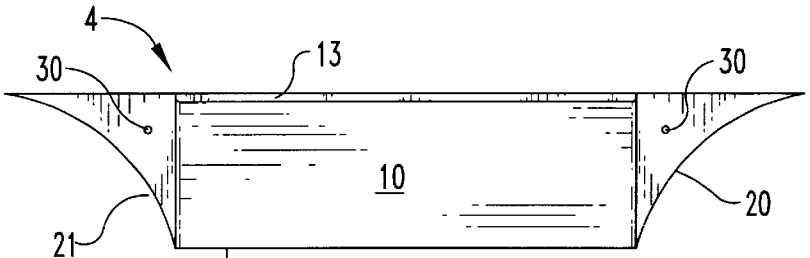
Figure 6A:
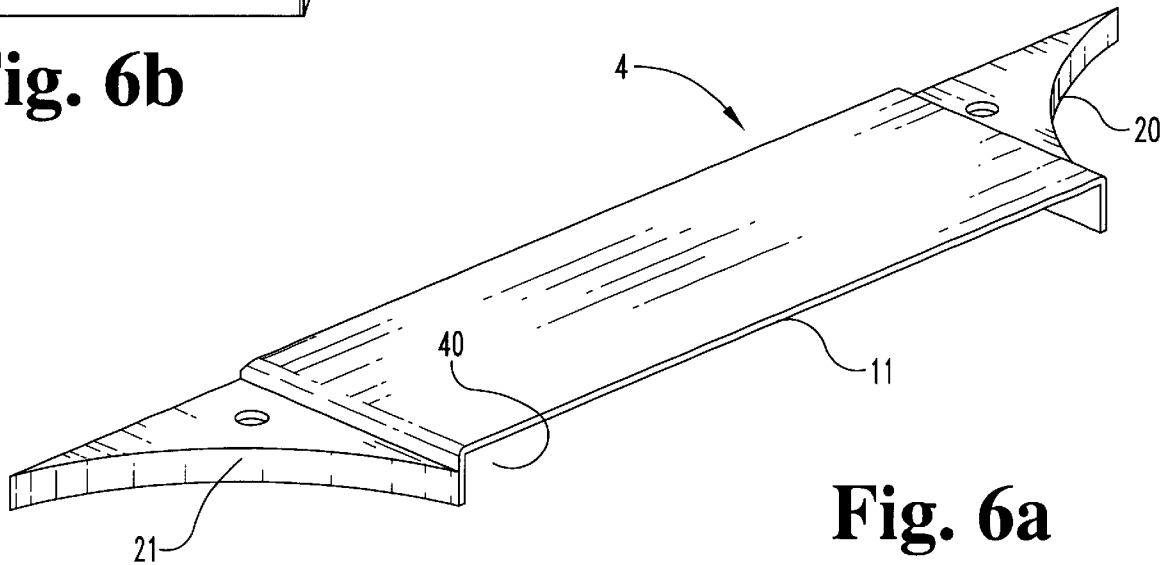
Figure 7D:
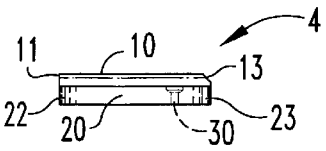
Figure 7C:
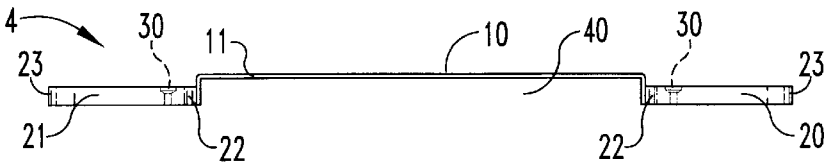
Figure 7B:
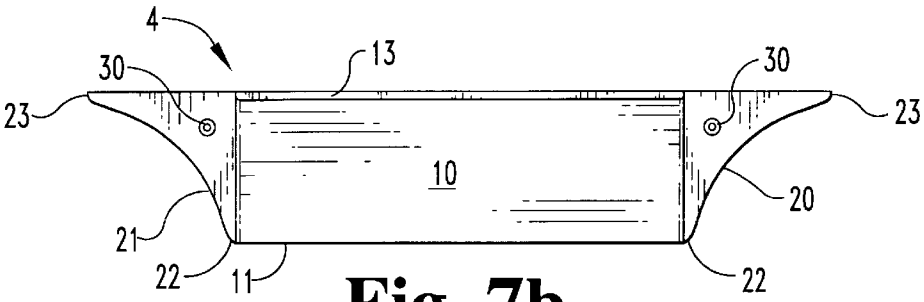
Figure 7A:
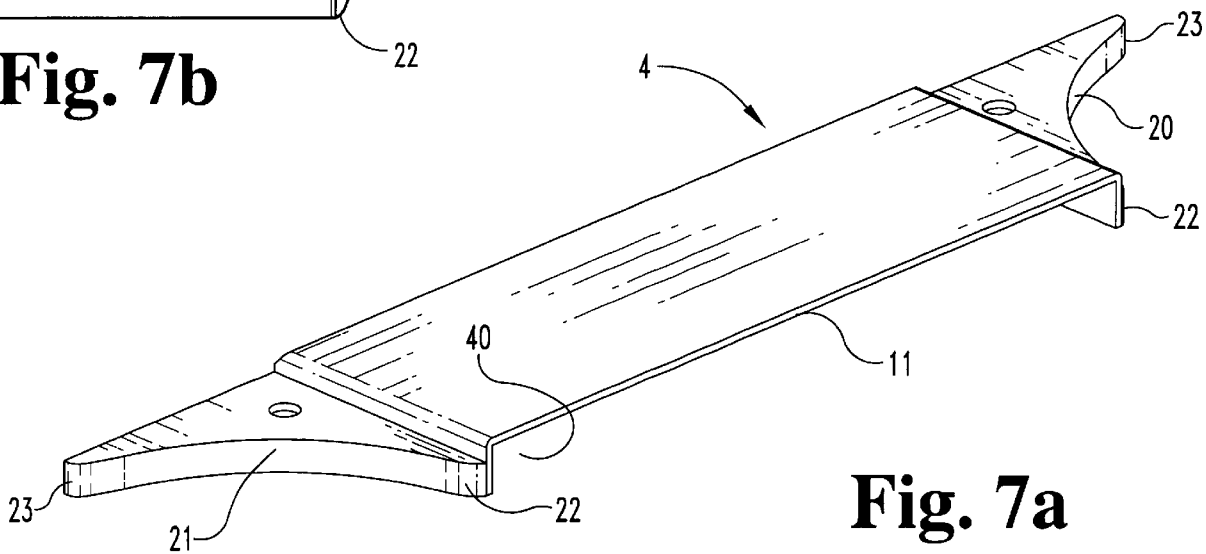
Figure 8D:
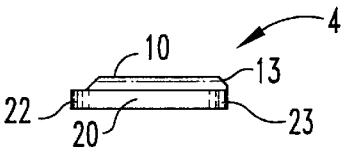
Figure 8C:
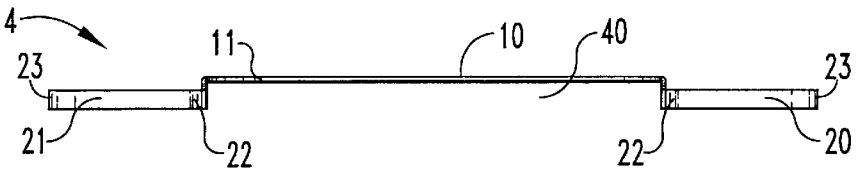
Figure 8B:
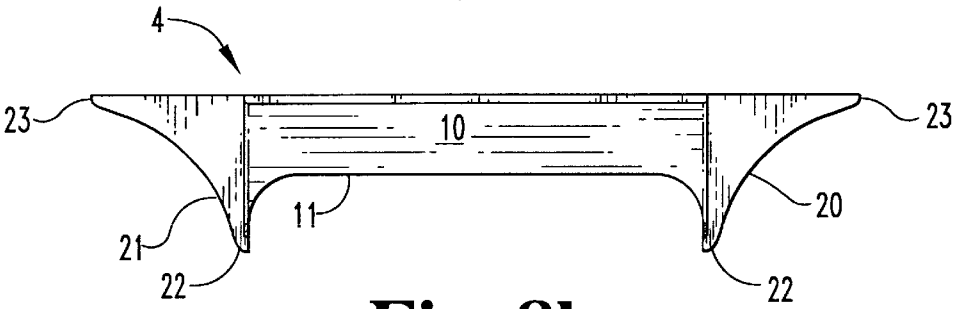
Figure 8A:
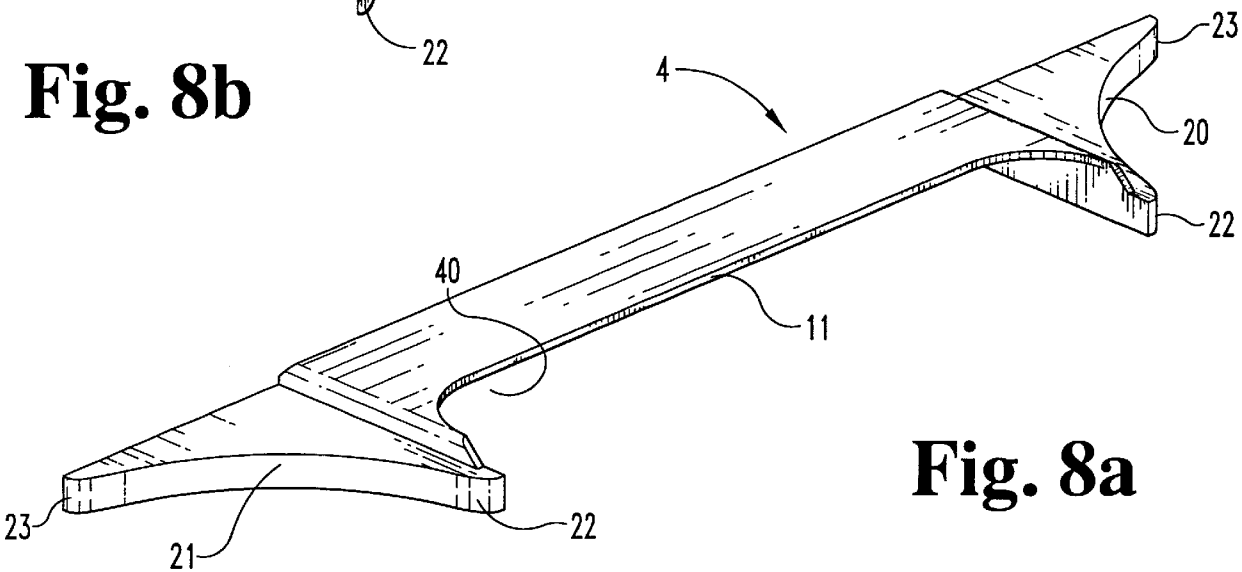
Figure 9:
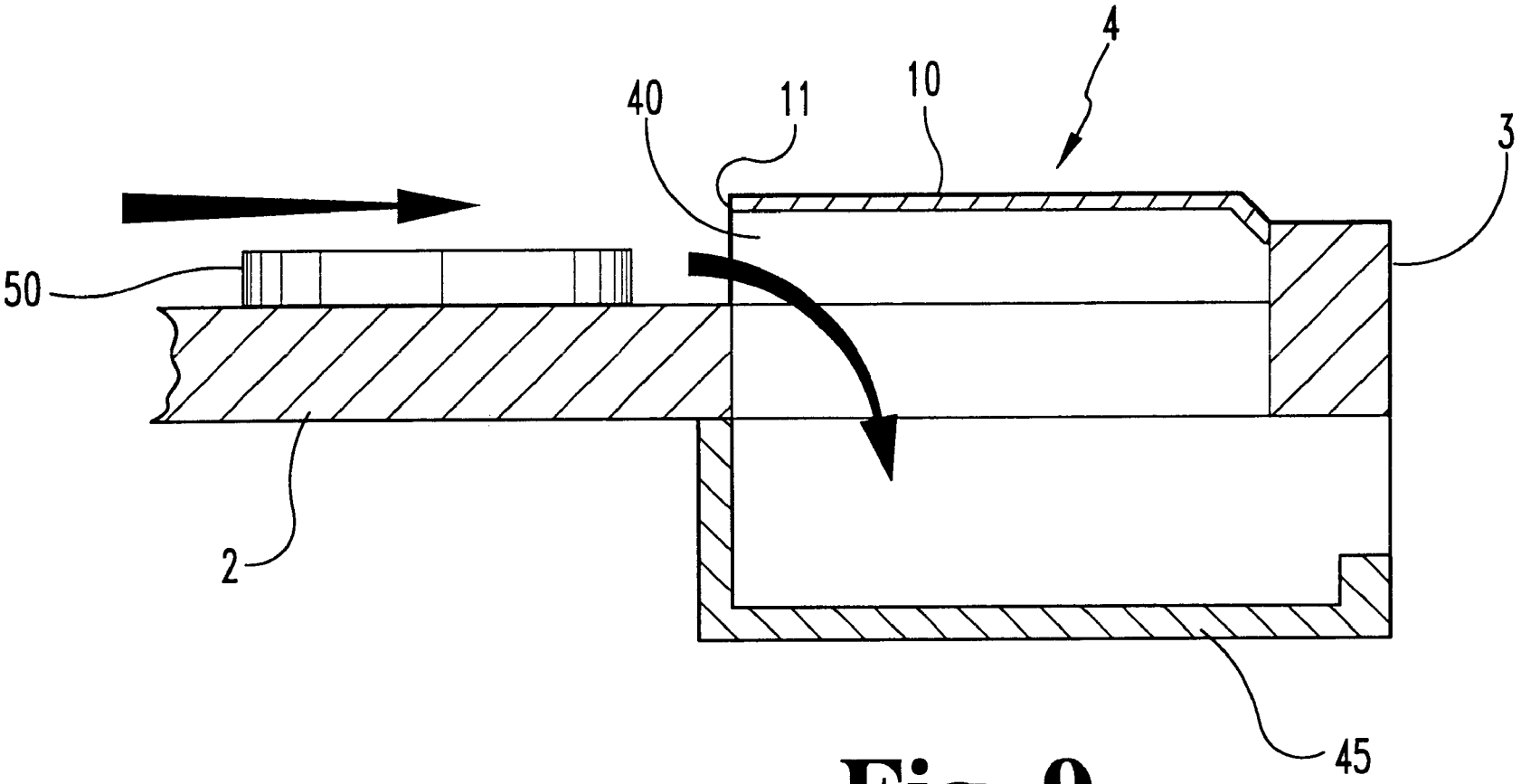
FIG. 9 is a cut-away side view of the novel scoring hood attached to an air hockey table showing a puck retrieval trough under the scoring hood.

For promoting an understanding of the invention, specific descriptive language will be used and references will be made to the embodiments illustrated in the drawings. Nonetheless, no limitation of the scope of the invention is intended by the necessary limitations of language and space. Further modifications of the described embodiments and further applications of the principles of the invention as described herein as would normally occur to one skilled in the related art are contemplated as additional obvious embodiments of the present invention.

The present invention is a scoring hood for a gaming table, as for example a conventional air hockey table, though the scoring hood of the present invention may be useful in other table games involving a puck, ball or other play object where the object of the game is to maneuver the puck, ball or other object into a goal. FIG. 1 diagrammatically shows such a conventional gaming table 1 having a substantially horizontal playing area 2 with an edge 3. Typically the edge 3 is a side or other raised barrier designed to retain the puck, ball or other play object in play on the playing area 2. The table 1 shown in FIG. 1 shows two scoring hoods 4 affixed to the table 1 at opposite ends of the playing area 2 abutting the edge 3.

The scoring hood 4 comprises a top 10 having at least an inner edge 11 that extends outwardly into the playing area 2 relative to the edge 3. In a preferred embodiment the inner edge 11 is substantially parallel to the portion of edge 3 proximal to the scoring hood 4. The top 10 is spaced above the surface of the playing area 2 sufficient to allow a puck, ball or other play object to pass the inner edge 11 underneath the top 10.

Playing hood 4 further comprises a first side 20 and a second side 21 adjoining top 10 to define a goal opening 40 between said first side 20, second side 21, top inner edge 11 and the surface of the playing area 2. Each of said first side 20 and second side 21 includes a substantially vertical surface curving concavedly outward from goal opening 40 to edge 3. In a preferred embodiment, the curved, substantially vertical surface is perpendicular to the surface of playing area 2. Alternatively, the curved, substantially vertical surface may be slanted or curved relative to perpendicular from the playing area 2, provided it presents to a puck, ball or other playing object traversing playing area 2 a contact surface able to retain the puck, ball or other object in play on the playing area 2.

The first side 20 and second side 21 may be of the same height as goal opening 40 or any fraction thereof provided it is sufficiently high to provide a contact surface able to retain a puck, ball or other play object in play on the playing area 2.

In a preferred embodiment first side 20 and second side 21 are mirror images of one another. The curvature of first side 20 and second side 21 may be any concave curvature, but preferred embodiments include circular, parabolic, hyperbolic, and arcuate. In another preferred embodiment the curvature of first side 20 and second side 21, each having first ends 22 adjoining goal opening 40 and second ends 23 adjoining playing area edge 3, are convexedly rounded to the goal opening 40 and the playing area edge 3, respectively. (See FIGS. 3, 5 and 7.) The rounding provides additional strength against impact to prevent shattering of the scoring hood 4.

Other decorative and/or functional design features may be incorporated into the scoring hood 4 to satisfy aesthetic preferences, to fit the scoring hood to a particular design motif of the gaming table 1, or as desired for molding and finishing considerations. By way of example, but without limitation, such additional features may include rounded or beveled joints, vertical curvature of the top 10, and the placement and shaping of attachment features, as for example bevel 13 and screw holes 30. (See FIGS. 6 and 7.)

FIG. 8 shows another alternative embodiment wherein scoring hood inner edge 11 is in relief back from first ends 22 of first side 20 and second side 21, such that first side 20 and second side 21 extend beyond scoring hood inner edge 11, further out onto playing area 2. Alternatively, the ends of scoring hood inner edge 11 may be rounded to meet first side 20 and second side 21, as is shown by way of example, but without limitation in FIG. 8.

The scoring hood 4 of the present invention may be attached to the table 1 by conventional means as for example but without limitation screwing, bolting, nailing clamping, or gluing The scoring hood 4 to the playing surface 2, edge 3 or the underlying supports therefor. The scoring hood 4 of the present invention may alternatively be molded as an integral part of the table 1 or subpart thereof as for example the playing surface 2, edge 3, or as part of the puck or ball retrieval system, which is further attached to the table 1.

The scoring hood 4 of the present invention may be made from any resilient material able to withstand the impact of the puck, ball or other play item. Preferred materials are impact resistant plastics, hard rubbers, metal, or rigid, impact resistant composites, wood or wood laminates.

FIG. 8 shows a cross-sectional view of one embodiment of scoring hood 4 according to the present invention showing puck 50 entering goal opening 40 and a conventional puck retrieval system 45.

While the invention has been illustrated and described in detail in the drawings and foregoing descriptions, this is to be considered illustrative and not restrictive. It is to be understood that only the preferred embodiments have been shown and described. All modifications and equivalents of the elements of the disclosed invention that come within the spirit of the invention as defined by the following claims are contemplated and their protection is desired.

What is claimed is:

1. A scoring hood for a gaming table having a horizontal playing area with at least one edge, the scoring hood comprising:

a top having an inner edge substantially parallel to an edge of the playing area and being extended into the playing area; and a first side and a second side joined with the top and defining a goal opening between said first and second sides, the inner edge of the top, and the playing area, each of said first and second sides including a substantially vertical surface curving concavedly outward from the goal opening to the edge of the playing area.

2. The scoring hood of claim 1 wherein the curvatures of the concave surfaces of the first and second sides are the mirror image of one another.

3. The scoring hood of claim 2 wherein the curvatures of the concave surfaces of the first and second sides are circular.

4. The scoring hood of claim 2 wherein the curvatures of the concave surfaces of the first and second sides are parabolic.

5. The scoring hood of claim 2 wherein the curvatures of the concave surfaces of the first and second sides are hyperbolic.

6. The scoring hood of claim 2 wherein the curvatures of the concave surfaces of the first and second sides are arcuate.

7. The scoring hood of claim 2 wherein the concave surfaces of the first and second sides have first ends at the goal opening and second ends at the edge of the playing area and wherein said first and second ends are convexedly rounded to the goal opening and the edge of the playing area, respectively.

8. A gaming table comprising a horizontal playing area having an edge and a scoring hood extending into the playing area from the edge, said scoring hood having a top and a first side and a second side defining a goal opening therebetween, each of said first and second sides including a substantially vertical surface curving concavedly outward from the goal opening to the edge of the playing area.

9. The gaming table of claim 8 wherein the curvatures of the concave surfaces of the first and second sides are the mirror image of one another.

10. The gaming table of claim 8 wherein the curvatures of the concave surfaces of the first and second sides are circular.

11. The gaming table of claim 8 wherein the curvatures of the concave surfaces of the first and second sides are parabolic.

12. The gaming table of claim 8 wherein the curvatures of the concave surfaces of the first and second sides are hyperbolic.

13. The gaming table of claim 8 wherein the curvatures of the concave surfaces of the first and second sides are arcuate.

14. The gaming table of claim 8 wherein the concave surfaces of the first and second sides have first ends at the goal opening and second ends at the edge of the playing area and wherein said first and second ends are convexedly rounded to the goal opening and the edge of the playing area, respectively.

15. The gaming table of claim 8 wherein the scoring hood first and second sides extend into the playing area further than the scoring hood top.

16. In a gaming table with a goal having a first side and a second side defining a goal opening therebetween, and a playing area with an edge, the improvement comprising the goal extending inward from the edge into the playing area and the first and second sides of the goal being curved concavedly from the goal opening to the edge of the playing area.

17. The air hockey gaming table of claim 15 wherein the curvatures of the concave surfaces of the first and second sides are the mirror image of one another.

18. The air hockey gaming table of claim 15 wherein the curvatures of the concave surfaces of the first and second sides are circular.

19. The air hockey gaming table of claim 15 wherein the curvatures of the concave surfaces of the first and second sides are parabolic.

20. The air hockey gaming table of claim 15 wherein the curvatures of the concave surfaces of the first and second sides are hyperbolic.

21. The air hockey gaming table of claim 15 wherein the curvatures of the concave surfaces of the first and second sides are arcuate.

22. The air hockey gaming table of claim 15 wherein the concave surfaces of the first and second sides have first ends at the goal opening and second ends at the edge of the playing area and wherein said first and second ends are convexedly rounded to the goal opening and the edge of the playing area, respectively.

* * * * *